US006408601B1

(12) United States Patent
Odenthal et al.

(10) Patent No.: US 6,408,601 B1
(45) Date of Patent: Jun. 25, 2002

(54) APPARATUS FOR FILLING PACKAGING CONTAINERS

(75) Inventors: Heinz F. Odenthal, Zülpich; Marian Cioc, Euskirchen, both of (DE)

(73) Assignee: Nor-Reg AS, Honefoss (NO)

( * ) Notice: Subject to any disclaimer, the term of this patent is extended or adjusted under 35 U.S.C. 154(b) by 0 days.

(21) Appl. No.: 09/437,460

(22) Filed: Nov. 10, 1999

(30) Foreign Application Priority Data

Nov. 11, 1998 (DE) ..... 198 51 801

(51) Int. Cl.[7] ..... B65B 57/14

(52) U.S. Cl. ..... 53/493; 53/233; 53/540; 198/430

(58) Field of Search ..... 53/233, 247, 252, 53/258, 493, 540; 198/430, 462.3

(56) References Cited

U.S. PATENT DOCUMENTS 4,399,905 A * 8/1983 Lance ..... 198/430
4,927,322 A * 5/1990 Schweizer ..... 198/430
5,768,856 A * 6/1998 Odenthal ..... 53/247

FOREIGN PATENT DOCUMENTS

| | | |
|---|---|---|
| DE | 36 40 665 A | 6/1988 |
| DE | 42 25 062 | 2/1993 |
| DE | 42 25 063 | 2/1993 |
| EP | 0 778 203 | 6/1997 |

* cited by examiner

*Primary Examiner*—John Sipos
(74) *Attorney, Agent, or Firm*—Herbert Dubno; Andrew Wilford

(57) ABSTRACT

A pocket belt is continuously advanced by a drive at a variable pocket-belt speed, and a package supply feeds packages at a variable spacing one after another to a transfer station offset from the pocket belt. A feeding system has an intermediate belt extending through the transfer station from the supply to the pocket belt, and a drive for advancing the intermediate belt at an intermediate-belt speed and thereby moving the packages on the intermediate belt at the intermediate-belt speed from the supply to the pocket belt. A controller connected to the drives maintains the intermediate speed at a predetermined ratio to the pocket-belt speed as determined by the spacing between succeeding packages as they arrive at the transfer station from the supply.

4 Claims, 2 Drawing Sheets

APPARATUS FOR FILLING PACKAGING CONTAINERS

FIELD OF THE INVENTION

The invention relates to an apparatus for filling one or more packaging containers with one or more packages that stand next to one another in a packaging container.

BACKGROUND OF THE INVENTION

Such an apparatus has a continuously driven pocket belt guided in a closed path and having pockets arrayed in the transport direction for receiving the individual packages, a feed conveyor that feeds the individual packages to the individual pockets at a transfer station, and a filling station in which the packages in the pockets are simultaneously moved by an unloading device in a direction orthogonal to a transport direction of the pocket belt and also in a direction parallel to the transport direction of the pocket belt. Then they are directly transferred to one or more packaging containers. The packages can be of the same or different types.

Such an apparatus is shown in EP 0,778,203. Here the suggestion is made to execute the orthogonal and parallel movement directions by a slide that is movable at an acute angle to the transport direction of the pocket belt. This angle is fixed in advance and cannot be changed. Thus synchronous advance of the slide, that is with a speed whose speed component parallel to the transport direction of the pocket belt is equal to the advance speed of the pocket belt, always pushes out a constant number of packages which makes the apparatus relatively inflexible.

In order to change the number of the pushed-out packages the slide must be moved at another speed not synchronized with the pocket belt which however is problematic because of the no longer synchronized speeds parallel to each other.

It is also possible to fill single not moving packaging containers with an auxiliary device working for example with an also moving intermediate storage system. Often here an apparatus is needed for moving the packaging container parallel and synchronously with the pocket belt.

German published application 4,225,063 describes such an apparatus. The auxiliary device is a so-called help seat that must be moved synchronously with the conveying device (the pocket belt) and into which the items to be unloaded (the packages) are first unloaded before they can actually be sent on to the next conveyor device (corresponding to transfer to the packaging containers).

OBJECT OF THE INVENTION

It is an object of the invention to provide an easy-to-manufacture, inexpensive, and easy-to-use device of the above-mentioned type that can be controlled simply and whose control is flexible and that can push out a constant or varying number of packages and fill them into the packaging containers.

SUMMARY OF THE INVENTION

This object is achieved according to the invention by an apparatus characterized in that the unloading device has two drives by means of which the unloading movements are controlled independently of each other in the movement directions.

In this manner a fixed predetermined angle is avoided. Changing the speed of one of the drives while simultaneously maintaining the speed of the other drive produces another angle between the conveyor device of the pocket belt and the push-out movements that are formed from the two individual movement directions. Thus in a simple manner different numbers of packages can be pushed out.

In addition the drives can be driven jointly or singly forward or backward which further increases the applications. Thus for example while maintaining a relatively small advance speed of the pocket belt of the first drive only the second drive can be actuated with a relatively great speed so that the packages are pushed generally orthogonally to the transport direction of the pocket belt for transfer into one or more nonmoving packaging containers. In this manner direct or proximal filling of nonmoving packaging containers is possible without auxiliary devices such as movable intermediate storage devices or devices for moving the packaging containers.

The apparatus is easy to operate and simple to construct so that it is inexpensive to manufacture.

In a preferred embodiment the drives are linear drives. They can also be servomotors.

It is particularly simple when the unloading device has a slide movable by the first drive parallel to the transport direction of the pocket belt and carrying a push-out element movable by the second drive transversely to the transport direction of the pocket belt.

It is further particularly advantageous when the unloading device has a slide movable by the first drive parallel to the transport direction of the pocket belt and carrying a push-out element, in particular a chain or belt, having a portion movable parallel to the transport direction of the pocket belt and carrying at least one push-out element movable by the second drive transversely to the transport direction of the pocket belt. Since here the masses of the second drive or several second drives as well as the push-out element are not subject to any accelerations or brakings by reciprocation, but instead these masses are moved continuously, the system can easily be driven while achieving a high unloading capacity.

It is also known to make the apparatus such that an intermediate belt is provided between the input conveyor and the pocket belt for compensating out variations in the spacings between the packages fed in by the supply conveyor. Above all in this arrangement, as also known from EP 0,778,203, there is on the supply conveyor as well as on the intermediate belt a sensor as well as separate drives for the intermediate belt and the pocket belt which entails a considerable expense in manufacturing and controlling the system.

It is thus particularly advantageous when the intermediate belt is driven with the same type of package at a constant speed ratio to the pocket belt. A constant speed ratio between the pocket belt and the intermediate belt means both belts have the same load measured in packages per unit of time. Thus deviations in the spacings of the incoming packages can be ascertained by a single sensor and only one speed needs to be changed, namely that of the intermediate belt and pocket belt. By changing the speeds of the intermediate belt and also of the pocket belt the spacing changes can be compensated out so that all pockets of the pocket belt are continuously filled.

Thus with such a system no wholly new and expensive setup of the apparatus is needed when the packages change. Changeover from one to another type of package with different dimensions can be done very quickly and simply without cost-intensive interruptions. It is particularly advantageous when the intermediate belt is provided with one or more entrainment elements for the packages.

It is further particularly advantageous when the intermediate belt and the pocket belt are each driven by an electric motor, preferably a servomotor, and are provided with a controller that operates the two motors at a constant speed ratio relative to each other. In this manner the apparatus is still usable flexibly with respect to various package sizes. Accommodation to another package type can thus be done electronically quickly and simply.

It is also possible to connect the pocket belt with the intermediate belt by a mechanical transmission. In this system it is preferable for the drive to have several transmission ratios.

It is also possible to operate the apparatus without an intermediate belt. Here however when changing the packaging type relatively expensive particular devices, for example brakes or hold-back devices are necessary as is the case with the apparatus known from EP 0,778,203.

BRIEF DESCRIPTION OF THE DRAWING

Further advantages and features of the invention are seen in the following specific description and the embodiment shown in the drawing. Therein.

SPECIFIC DESCRIPTION

Figure 1:
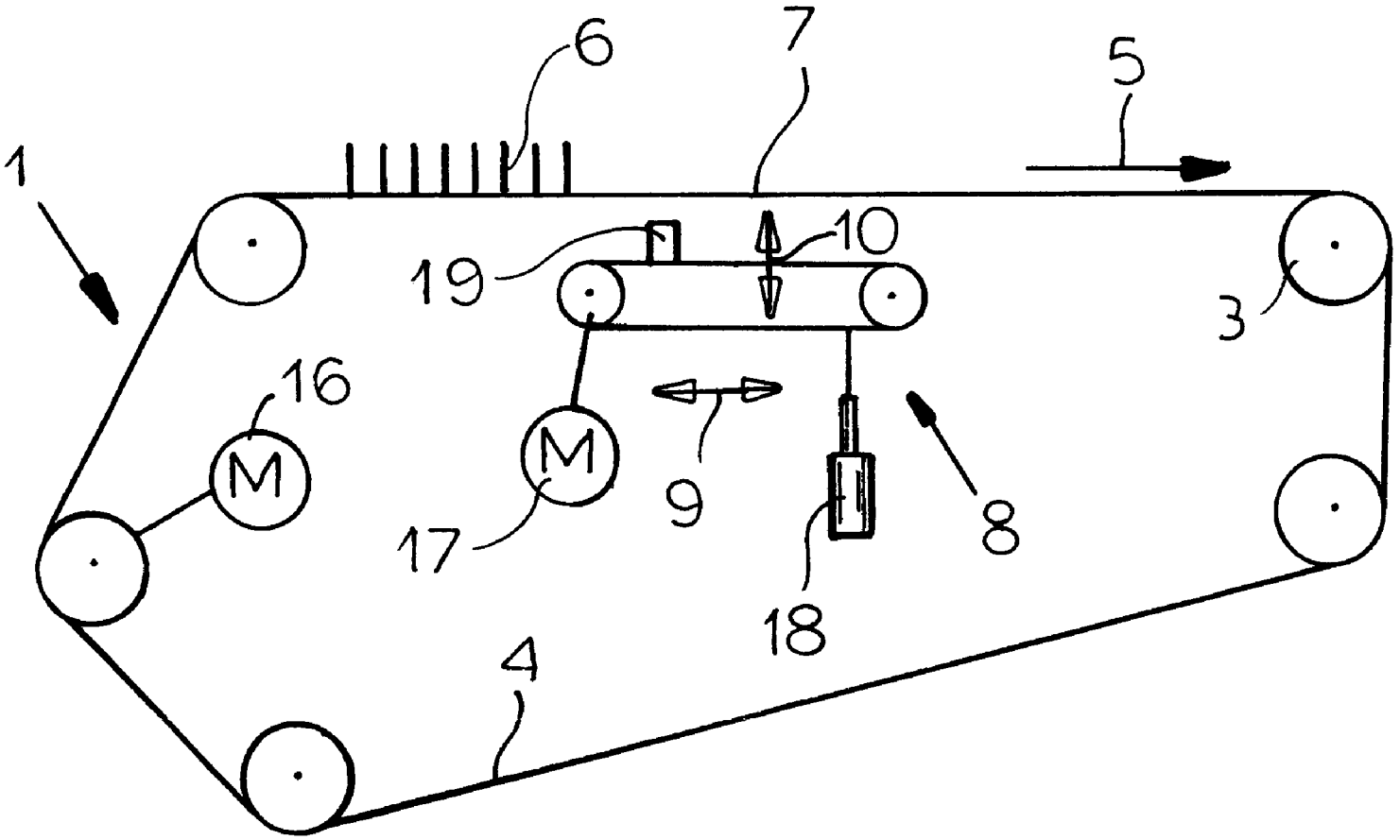
FIG. 1 is a schematic representation of an apparatus with a filling station according to the invention.

The apparatus shown in FIG. 1 for filling containers with several packages 2 has a pocket belt 4 guided in a closed path over several rollers 3 and continuously driven by a motor 16. This pocket belt 4 has spaced apart in a transport direction 5 adjacent rows of pockets 6 for receiving the individual packages 2. FIG. 1 only shows the individual pockets 6 in the upper stretch of the belt 4.

In the middle of a straight upper transport stretch 7 of the pocket belt 4 is a filling device 8. It has two drives 17 and 18 that operate independently of each other. The first drive 17 serves to move a slide 19 in a movement direction 9 parallel to the transport direction of the pocket belt 4. The second drive 18 serves to move the slide 19 in a movement direction 10 orthogonal to the transport stretch 7 of the pocket belt 4.

Since both drives 17 and 18 can be controlled individually or jointly independently of each other, packages 2 can be slid out of the pockets 6 of the pocket belt 4 with great flexibility so as to fill package containers. The different speeds in the two movement directions 9 and 10 can produce push-out directions at various angles to the transport stretch 7 of the pocket belt 4.

It is particularly possible to stop the first drive 17 and only execute a push-out movement with the second drive 18 orthogonally of the transport stretch 7. In this manner individual stationary package containers can be loaded without needing an intermediate storage place or moving the package containers parallel to and synchronously with the pocket belt 4.

Figure 2:
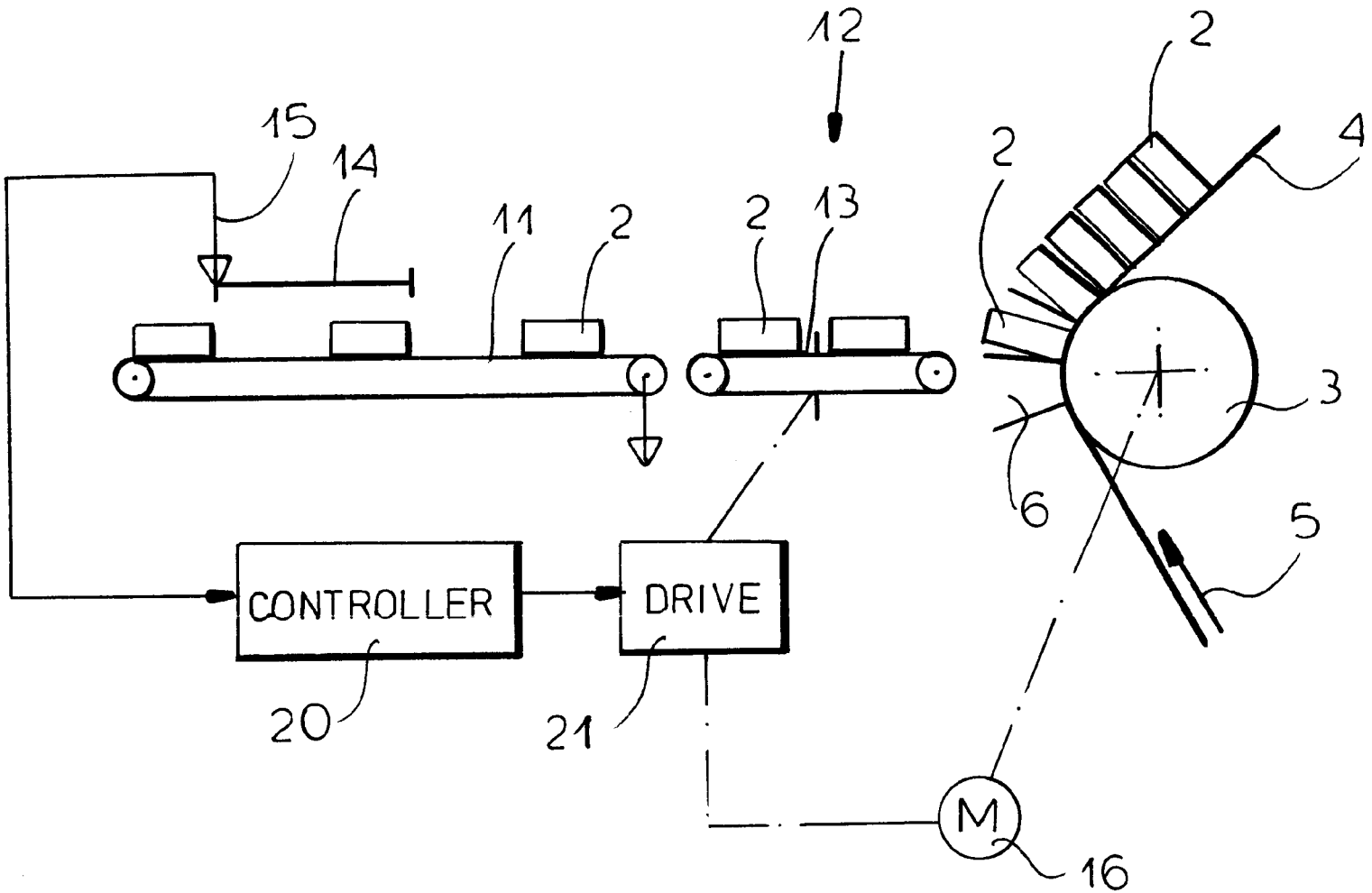
FIG. 2 is a schematic representation of a transfer station according to the invention.

FIG. 2 shows a feed conveyor 11 that supplies the individual packages 2 to the individual pockets 6 of the pocket belt 4 at a transfer station 12. Between the feed conveyor 11 and the pocket belt 4 is an intermediate belt 13 that can compensate out variations in the spacings of the packages 2 fed in by the feed conveyor 11. The individual packages 2 are thus first set by the feed conveyor 11 on an input end of the intermediate conveyor 13 and at its output end they are transferred to the pockets 6 of the pocket belt 4.

The intermediate belt 13 is in fact operated by a controller 20 always at a speed forming a fixed ratio with the speed of the pocket belt 4 determined by the packages 2 currently being handled, that is when variations occur in the spacings 14 between the supplied packages 2 the speeds of the intermediate belt 13 and of the pocket belt 4 are increased or decreased by the same percentage so that one achieves a constant filling of each individual pocket 6 with an individual package 2. To this end only a single sensor 15 is needed which is arranged on the supply conveyor 11 and which determines the spacings 14 between the incoming packages 2. A further sensor on the intermediate belt 13 or on the pocket belt 4 is not necessary since there must be no separate control of the intermediate belt 13 and of the pocket belt 4, both belts 4 and 13 being controlled jointly through a drive 21 that may include a separate motor for the belt 13 operated synchronously with the drive motor 16 for the belt 4 or a multispeed transmission connecting the driven belt 13 to the belt 4.

As a result of this joint control by means of which the intermediate belt 13 and the pocket belt 4 are driven at a constant speed ratio, the precision of the transfer of the packages 2 to the pocket belt 4 is increased and the entire lengths of the pockets 6 can be used so that a higher throughput is achieved. Accommodating the length of the intermediate belt 13 to the lengths of the individual packages is thus not necessary.

What is claimed is:

1. In combination:

means including a package supply for feeding packages at a variable spacing one after another to a transfer station;

a pocket belt offset from the transfer station;

an intermediate belt extending through the transfer station from the supply to the pocket belt;

drive means for continuously advancing the pocket belt at a variable pocket-belt speed;

drive means for advancing the intermediate belt at a variable intermediate-belt speed forming a predetermined ratio with the pocket-belt speed and thereby moving the packages on the intermediate belt from the supply to the pocket belt;

a single sensor for determining the spacing between succeeding packages only at the supply; and control means connected to the pocket-belt drive means, to the intermediate-belt drive means, and to the sensor means for changing the predetermined ratio in accordance with the sensed spacing between succeeding packages as they arrive at the transfer station from the supply, whereby the speeds are varied so the intermediate-belt speed forms a greater proportion of the pocket-belt speed when the sensed spacing increases and the speeds are varied so the intermediate-belt speed forms a smaller proportion of the pocket-belt speed when the sensed spacing decreases.

2. The pocket-belt feeding system defined in claim 1 wherein the drive means include respective motors connected to the respective belts.

3. The pocket-belt feeding system defined in claim 1 wherein the drive means include a transmission connected between the belts.

4. The pocket-belt feeding system defined in claim 3 wherein the transmission is multispeed.

* * * * *